United States Patent [19]

Tsutsumi et al.

[11] 4,395,705

[45] Jul. 26, 1983

[54] TROUBLE-SHOOTING CIRCUIT WITH FIRST-FAILURE IDENTIFICATION CAPABILITY

[75] Inventors: Kazuhiro Tsutsumi; Genichiro Tanoue; Yoshiaki Takaya, all of Tokyo, Japan

[73] Assignee: Toyo Electronics Corporation, Tokyo, Japan

[21] Appl. No.: 240,215

[22] Filed: Mar. 3, 1981

[51] Int. Cl.[3] ..... G08B 23/00

[52] U.S. Cl. ..... 340/520; 340/506; 340/507; 340/523

[58] Field of Search ..... 340/520, 506, 507, 510, 340/511, 537, 508, 517, 519, 521, 501, 537, 524–527, 52 R, 635, 523

[56] References Cited

U.S. PATENT DOCUMENTS 3,500,469 3/1970 Plambeck et al. ..... 340/520
3,631,432 12/1971 Stallebrass ..... 340/520
3,702,473 11/1972 Fink ..... 340/511
3,786,501 1/1974 Marnerakis ..... 340/511

*Primary Examiner*—John W. Caldwell, Sr.
*Assistant Examiner*—Donnie L. Crosland
*Attorney, Agent, or Firm*—George B. Oujevolk

[57] ABSTRACT

A trouble-shooting circuit arrangement for localizing and identifying the first failure in time in a sequence of failures which has a plurality of monitor circuits including trouble detector circuits for producing direct current outputs in response to the occurence of failure or trouble at various contact points and trouble localization circuits for identifying the trouble which has occurred in any of the monitor circuits, identifying such factors as coolant, pressure, temperature, fuel and the like in an engine. The arrangement locates the first failure or trouble in time, which has occurred in any of the circuits so as to remedy the countermeasures of the equipment against the occurence of trouble or failure therein.

4 Claims, 5 Drawing Figures

TROUBLE-SHOOTING CIRCUIT WITH FIRST-FAILURE IDENTIFICATION CAPABILITY

BACKGROUND OF THE INVENTION

This invention relates to a device for identifying and localizing a fault by means of a multiple position or element monitoring apparatus and, more particularly, to a first in-time failure or trouble localization circuit arrangement for identifying a failure which has occurred initially when circuit troubles are taking place at a plurality of positions or elements in a multipoint monitoring apparatus.

When a variety of factors such as coolant, pressure, temperature, fuel and the like are monitored, for example, in an engine, if plural factors malfunction sequentially, it is very important to identify the first failure and the point where this has occurred in order to remedy the cause of the troubles and correct the countermeasure against the troubles.

A malfunction alarm lamp therefore blinks ON and OFF and indicates normally the first fault in time which occurs at a point, and the second and later faults are indicted by the continuous energization of corresponding alarm lamps or by varying the period of the blinking of the alarm lamps so that a supervisor can easily identify the faults.

The conventional means for identifying such faults however employs a number of complicated circuits in the fault identifying circuit, resulting in an expensive construction and fails to render satisfactory service.

OBJECTS OF THE INVENTION

Accordingly, an object of this invention is to provide a circuit arrangement which will locate and indentify the first failure which has occurred in a time sequence and which can eliminate the disadvantages of the conventional device and has a simple construction with very reliable members for identifying any trouble therein.

It is another object of this invention to provide a trouble location circuit device which can identify the first failure or trouble in time which has occurred therein merely by connecting one wire or line to the circuit.

It is yet another object of this invention to provide a circuit arrangement for locating trouble which has storage means for holding information as to trouble even after the fault contact is disconnected.

It is further object of this invention is to provide a circuit which can identify the state of an alarm circuit irrespective of the operation of the identifying circuit.

It is still another object of this invention to provide a circuit device which does not affect adversely the operation of the stoppage of the alarm circuit or the the fault identifying operation thereof.

SUMMARY OF THE INVENTION

According to this invention, there is provided a circuit arrangement for locating and identifying the first failure in time which employs circuit groups in which predetermined points of fault identifying circuits are connected in a very simple configuration using silicon controlled rectifiers to identify the first trouble in time.

BRIEF DESCRIPTION OF THE DRAWINGS

The above and other related objects and features of the invention will be apparent from a reading of the following detailed description and the accompanying drawings, in which.

DESCRIPTION OF THE PREFERRED EMBODIMENTS

Figure 1:
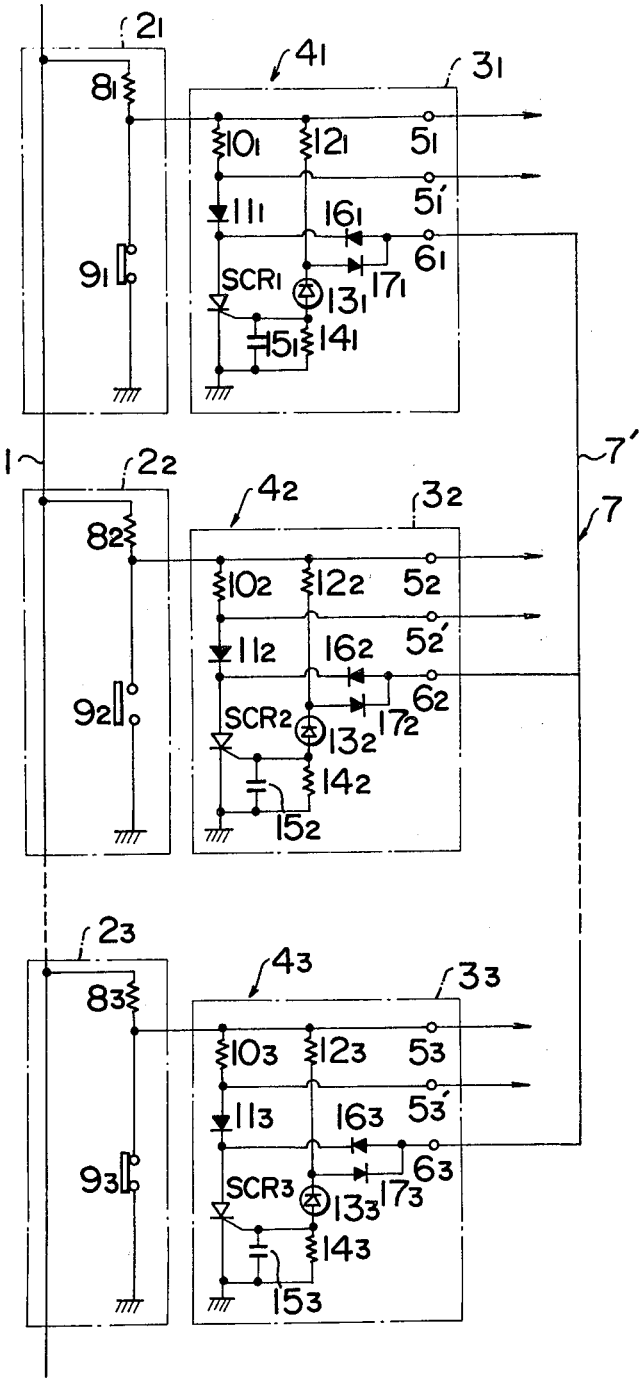
FIG. 1 is a circuit diagram showing one preferred embodiment of the electrical circuit arrangement contemplated herein.

Referring now to the drawings, particularly to FIG. 1 showing one preferred embodiment of the circuit device constructed according to this invention, wherein like reference numerals designate the same parts in the following views, trouble detector circuits $\mathbf{2}_1$, $\mathbf{2}_2$, $\mathbf{2}_3$, . . . connected to a common DC power line 1 and trouble localization shooting circuits $\mathbf{3}_1$, $\mathbf{3}_2$, $\mathbf{3}_3$ connected to the detector circuits $\mathbf{2}_1$, $\mathbf{2}_2$, $\mathbf{2}_3$, . . . , respectively form monitor circuits $\mathbf{4}_1$, $\mathbf{4}_2$, $\mathbf{4}_3$, . . . , respectively for monitoring temperature, pressure, fuel or the like. The shooting circuits $\mathbf{3}_1$, $\mathbf{3}_2$, $\mathbf{3}_3$, . . . respectively consist of first and second output terminals $\mathbf{5}_1$, $\mathbf{5}_1'$; $\mathbf{5}_2$, $\mathbf{5}_2'$; $\mathbf{5}_3$, $\mathbf{5}_3'$; . . . and lock signal terminals $\mathbf{6}_1$, $\mathbf{6}_2$, $\mathbf{6}_3$, . . . , wherein the lock signal terminals of the respective shooting circuits $\mathbf{3}_1$, $\mathbf{3}_2$, $\mathbf{3}_3$, . . . are connected to each other to form a lock circuit 7 through a lock line 7' as will be described in greater detail.

The trouble detector circuits $\mathbf{2}_1$, $\mathbf{2}_2$, $\mathbf{2}_3$, . . . exemplified in FIG. 1 consist respectively of resistors $\mathbf{8}_1$, $\mathbf{8}_2$, $\mathbf{8}_3$, . . . and trouble contacts $\mathbf{9}_1$, $\mathbf{9}_2$, $\mathbf{9}_3$, . . . connected in series with the respective resistors $\mathbf{8}_1$, $\mathbf{8}_2$, $\mathbf{8}_3$, . . . for normally closing and opening upon occurrence of trouble or failure such as temperature rise or the like connected between the DC power line 1 and ground, and produce and apply respectively outputs from between the respective resistors and the trouble contacts to the first output terminals $\mathbf{5}_1$, $\mathbf{5}_2$, $\mathbf{5}_3$, . . . of the shooting circuits $\mathbf{3}_1$, $\mathbf{3}_2$, $\mathbf{3}_3$, . . . .

Further, the shooting circuits $\mathbf{3}_1$, $\mathbf{3}_2$, $\mathbf{3}_3$, . . . exemplified in FIG. 1 consist respectively of first resistors $\mathbf{10}_1$, $\mathbf{10}_2$, $\mathbf{10}_3$, . . . , first diodes $\mathbf{11}_1$, $\mathbf{11}_2$, $\mathbf{11}_3$, . . . , and silicon controlled rectifiers $SCR_1$, $SCR_2$, $SCR_3$, . . . connected in series with each other between the first output terminals $\mathbf{5}_1$, $\mathbf{5}_2$, $\mathbf{5}_3$, . . . and the ground; second resistors $\mathbf{12}_1$, $\mathbf{12}_2$, $\mathbf{12}_3$, . . . connected to the first output terminals $\mathbf{5}_1$, $\mathbf{5}_2$, $\mathbf{5}_3$, . . . and constant-voltage diodes $\mathbf{13}_1$, $\mathbf{13}_2$, $\mathbf{13}_3$, . . . connected at respective one side to the respective resistors $\mathbf{12}_1$, $\mathbf{12}_2$, $\mathbf{12}_3$, . . . and at the other side to the gates of the respective silicon controlled rectifiers $SCR_1$, $SCR_2$, $SCR_3$, . . . for applying gate voltages thereto; resistors $\mathbf{14}_1$, $\mathbf{14}_2$, $\mathbf{14}_3$, . . . and capacitors $\mathbf{15}_1$, $\mathbf{15}_2$, $\mathbf{15}_3$, . . . connected as delay circuits in parallel with each other connected between the gates of the silicon controlled rectifiers $SCR_1$, $SCR_2$, $SCR_3$, . . . and the ground; and second and third diodes $\mathbf{16}_1$, $\mathbf{16}_2$, $\mathbf{16}_3$, . . . and $\mathbf{17}_1$, $\mathbf{17}_2$, $\mathbf{17}_3$, . . . connected at respective one ends to the lock signal terminals $6_1$, $6_2$, $6_3$, . . . and connected at the former the other ends to between the respective diodes $11_1$, $11_2$, $11_3$, respectively and the respective silicon controlled rectifiers $SCR_1$, $SCR_2$, $SCR_3$, respectively and connected at the latter the other ends to between the respective diodes $12_1$, $12_2$, $12_3$, . . . and the respective constant-voltage diodes $13_1$, $13_2$, $13_3$, . . . .

Since the trouble contacts $9_1$, $9_2$, $9_3$ are not closed unless all the monitoring circuits malfunction so that no outputs are produced from the trouble detector circuits $2_1$, $2_2$, $2_3$, . . . , respectively, no voltage is applied from the DC power line 1 to the trouble-circuits $3_1$, $3_2$, $3_3$, . . . , and both the first and second output terminals $5_1$, $5_1'$; $5_2$, $5_2'$; $5_3$, $5_3'$; . . . and the lock signal terminals $6_1$, $6_2$, $6_3$, . . . retain zero potentials (L level).

If trouble or a failure occurs and the trouble contact $9_2$ is accordingly opened, an electric current is flows from the DC power line 1 through the resistor $8_2$ to the trouble-circuit $3_2$. Therefore, both the output terminals $5_2$, $5_2'$ go to H level at this moment. However, after the delay time determined by the second resistor $12_2$, the resistor $14_2$ and the capacitor $15_2$ has elapsed, the constant-voltage diode $13_2$ conducts to allow the DC voltage to be applied to the gate of the silicon controlled rectifier $SCR_2$ and the rectifier $SCR_2$ which is triggered and conducts to become ON. Thus, the trigger current flows through the second resistor $12_2$ and the constant-voltage diode $13_2$ is abosrbed by the second resistor $12_2$, the third diode $17_2$, the second diode $16_2$ and the silicon controlled rectifier $SCR_2$, but since the current is a direct current, the silicon controller rectifier $SCR_2$ remains in the ON state as it is.

This circuit configuration incorporating the delay element is adopted in this circuit device because, even if the trouble shooting contact $9_2$ is instantaneously opened due to certain cause and an input is instantaneously applied to the shooting circuit $3_2$ due to disturbance, the silicon controlled rectifier $SCR_2$ may not be opened in response thereto.

When the silicon controlled rectifier $SCR_2$ is thus conducted to become ON, the first output terminal $5_2$ remains at the H level but the second output terminal $5_2'$ goes to the L level. A desired predetermined circuit, which will be hereinafter described as one example in greater detail with respect to FIG. 5, not shown in FIG. 1 is connected between both the terminals $5_2$ and $5_2'$ to detect the output between the terminals $5_2$ and $5_2'$ so as to confirm the fact that trouble occurs in this monitor circuit $4_2$ as distinguished from the other normal monitor circuits $4_1$, $4_3$, . . . being zero potential or level.

If the trouble shooting contact $9_1$ is then opened due to occurrence of the trouble or failure, the direct current is flown from the DC power line 1 to the shooting circuit $3_1$ in the same manner as the operation of the trouble shooting circuit $3_2$ as described previously. Therefore, the first and second output terminals $5_1$ and $5_1'$ goes to the H level. Since the lock circuit 7 which consists of a circuit by way of the second resistor $12_1$, the third diode $17_1$, the lock signal terminal $6_1$ the lock line 7', the lock signal terminal $6_2$, the second diode $16_2$, the conducting silicon controlled rectifier $SCR_2$ and the ground is however closed, no trigger is applied to the silicon controlled rectifier $SCR_1$, with the result that the silicon controlled rectifier $SCR_1$ remains OFF. Therefore, both the first and the second output terminals $5_1$ and $5_1'$ retain the H level as before, and the H and L levels occur only at the output terminals $5_2$ and $5_2'$ of the trouble shooting circuit $3_2$ in which the trouble or failure has initially taken place (i.e., first in time), but both the H levels occur at the output terminals $5_1$ and $5_1'$ of the trouble shooting circuit $3_1$ in which the trouble is has also taken place next in time order. Thus, both the troubles in the monitor circuits can be distinguished according to the sequence of the occurrence of the troubles. Since the output terminals of the trouble shooting circuits $3_3$, . . . go to both H level in the same manner as the second time sequence operation when the third trouble and the later troubles occur in the corresponding monitor circuits after the second sequence trouble, even if a number of monitor circuits are provided, the first trouble in time can be exactly identified.

Figure 2:
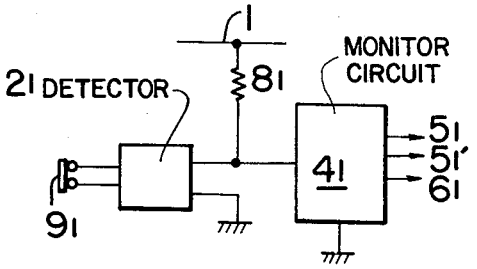
FIG. 2 is a block diagram of the trouble localization shooting circuit device shown in FIG. 1 but employing a reciprocating type switch at the failure contact therein.

It is noted that although a mechanical switch is exemplified as the trouble contact in the aforementioned embodiment, it is not limited only to this but a contactless output from a transistor or an IC circuit and the like may also be applied to the trouble shooting circuit when trouble occurs. It is also noted that when the trouble contact is not opened due to the occurrence of the trouble but returned to the original position after it is opened, a memory circuit may be applied between the resistor $8_1$ and the trouble contact $9_1$ as shown in FIG. 2.

Figure 3:
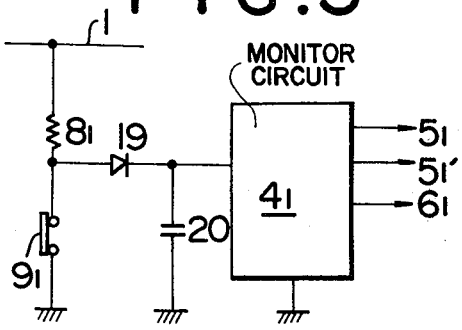
FIG. 3 is a block diagram of the circuit device shown in FIG. 1 but employing a smoothing circuit therein.

As shown in FIG. 3, in case that the electric current from the DC power line 1 is not a complete direct current but includes a ripple as is produced from a full-wave rectifier, it is preferable to insert a diode 19 between the trouble detector circuit $2_1$ and the trouble shooting circuit $3_1$ and to connect a smoothing capacitor 20 between the positive side of the diode 19 and the ground.

Figure 4:
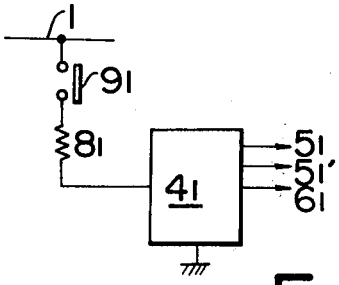
FIG. 4 is a block diagram of the circuit device shown in FIG. 1 but employing a normally open switch at the failure contact therein.

Further, it is also noted that when the trouble shooting contact is normally opened and closed upon occurrence of trouble, contrary to the situation in the previous embodiment, it is preferred to connect a trouble contact $9_1$ and a resistor $8_1$ connected in series between the DC power line 1 and the shooting circuit $3_1$ as shown in FIG. 4.

Figure 5:
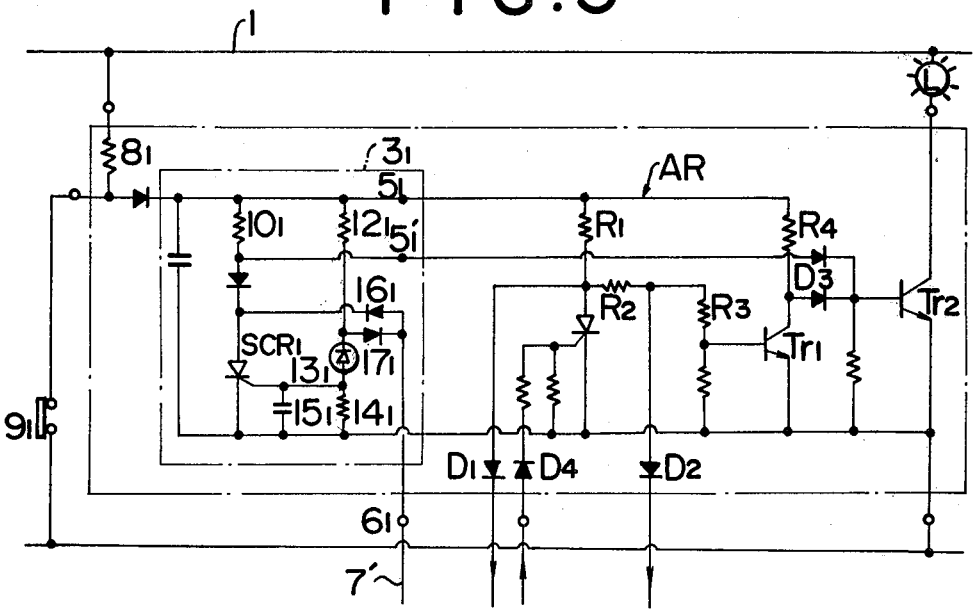
FIG. 5 is a circuit diagram of another preferred embodiment of the circuit device but connecting an alarm circuit to the electric circuit for identifying the trouble according to this invention.

Referring now to FIG. 5 showing an alarm circuit AR connected between the first and second output terminals $5_1$ and $5_2'$ as one example, since no input is applied from the DC power line 1 to the trouble shooting circuit $3_1$ when no trouble occurs but in normal state, no output is produced from the trouble shooting circuit $3_1$, and the alarm circuit AR is not operated. When trouble occurs in equipment to be monitored such as an engine auxiliary device, an input is applied from the DC power line 1 to the trouble shooting circuit $3_1$ as was described previously, the silicon controlled rectifier $SCR_1$ is conducts to become ON, with the result that a direct current flown from the output terminal $5_1$ through a resistor $R_1$ is partially applied through a diode $D_1$ to an alarm buzzer (not shown) as a drive output, and amplified through an output amplifier (not shown) and then drives the buzzer.

The direct current partially flows through a resistor $R_2$ and a resistor $R_3$ to the base of a transistor $Tr_1$, and is applied as an input signal through a diode $D_2$ between the resistors $R_2$ and $R_3$ so as to blink. Therefore, the base current of the transistor $Tr_1$ is bypassed through the diode $D_2$ according to the on or off of the flicker signal to become on or off, with the result that the transistor $Tr_1$ is repetitively on or off synchronously with the period of the blinking signal.

At this time the direct current which flows through a resistor $R_4$ is applied to the base of a transistor $Tr_{12}$ to render the transistor $Tr_1$ ON or OFF according to the flicker signal as above. Therefore, the transistor $Tr_2$ becomes ON or OFF according to the ON or OFF of the flicker signal to intermittently energize an alarm lamp L.

Assuming that the circuit shown in FIG. 5 has a failure which is first in time, the alarm lamp L blinks, but if the trouble is the second in time sequence, the silicon controlled rectifier $SCR_1$ shown remains OFF due to the closure of the lock circuit 7 as in the same manner described. Therefore, a direct current is applied to the base of the transistor $Tr_2$ by way of the resistor $\mathbf{10}_1$, the output terminal $\mathbf{5}_1'$, the diode $D_3$ in the trouble shooting circuit $\mathbf{3}_1$. As a result, even if the transistor $Tr_1$ goes ON or OFF, the transistor $Tr_2$ does not blink and the alarm lamp L is continuously energized, and the trouble can be identified which is first in time according to the blinking or continuous energization of the alarm lamp in this embodiment. It is noted that the trouble which is second and later in time can also be arbitrarily identified by deenergizing the lamp when the trouble which is second and later in time take place or by varying the frequency of the blinking as compared with the blinking for the first failure in time.

It is also noted that when a buzzer stop signal is applied through the diode $D_4$ externally from an external power source (not shown), a gate voltage is applied to the silicon controlled rectifier SCR to conduct the rectifier SCR which is deenergized so far so as to eliminate the drive output to the alarm buzzer.

It should be appreciated from the foregoing description that since the circuit arrangement contemplated herein comprises a plurality of monitor circuits $\mathbf{4}_1$, $\mathbf{4}_2$, $\mathbf{4}_3$, . . . having trouble detector circuits $\mathbf{2}_1$, $\mathbf{2}_2$, $\mathbf{2}_3$, . . . for producing direct current outputs in response to the occurrence of trouble or failures at trouble contacts $\mathbf{9}_1$, $\mathbf{9}_2$, $\mathbf{9}_3$, . . . and localizatin trouble trouble shooting circuits $\mathbf{3}_1$, $\mathbf{3}_2$, $\mathbf{3}_3$, . . . , said shooting circuits $\mathbf{3}_1$, $\mathbf{3}_2$, $\mathbf{3}_3$, . . . consisting of first resistors $\mathbf{10}_1$, $\mathbf{10}_2$, $\mathbf{10}_3$, . . . , first diodes $\mathbf{11}_1$, $\mathbf{11}_2$, $\mathbf{11}_3$, . . . , and silicon controlled rectifiers $SCR_1$, $SCR_2$, $SCR_3$, . . . connected in series with each other between the first output terminals $\mathbf{5}_1$, $\mathbf{5}_2$, $\mathbf{5}_3$, . . . and ground, second resistors $\mathbf{12}_1$, $\mathbf{12}_2$, $\mathbf{12}_3$, . . . connected to the first output terminals $\mathbf{5}_1$, $\mathbf{5}_2$, $\mathbf{5}_3$, . . . and constant-voltage diodes $\mathbf{13}_1$, $\mathbf{13}_2$, $\mathbf{13}_3$, . . . connected on one side to resistors $\mathbf{12}_1$, $\mathbf{12}_2$, $\mathbf{12}_3$ . . . and on the other side to the gates of the silicon controlled rectifiers $SCR_1$, $SCR_2$, $SCR_3$, . . . , a delay circuit connected between the gates of the respective silicon controlled rectifiers $SCR_1$, $SCR_2$, $SCR_3$, . . . and the ground, lock signal terminals $\mathbf{6}_1$, $\mathbf{6}_2$, $\mathbf{6}_3$, . . . connected through second diodes $\mathbf{16}_1$, $\mathbf{16}_2$, $\mathbf{16}_3$, . . . between the first diodes $\mathbf{11}_1$, $\mathbf{11}_2$, $\mathbf{11}_3$, . . . and the silicon controlled rectifiers $SCR_1$, $SCR_2$, $SCR_3$, third diodes $\mathbf{17}_1$, $\mathbf{17}_2$, $\mathbf{17}_3$ connected between the second resistors $\mathbf{12}_1$, $\mathbf{12}_2$, $\mathbf{12}_3$, . . . and the silicon controlled rectifiers $SCR_1$, $SCR_2$, $SCR_3$ to the lock signal terminals $\mathbf{6}_1$, $\mathbf{6}_2$, $\mathbf{6}_3$, . . . wherein the respective lock signal terminals $\mathbf{6}_1$, $\mathbf{6}_2$, $\mathbf{6}_3$, . . . in said trouble shooting circuits $\mathbf{3}_1$, $\mathbf{3}_2$, $\mathbf{3}_3$, . . . are connected with each other, it can consist of a simple construction with very reliable members in the trouble shooting circuits for identiying the trouble therein. Since the circuit contemplated herein can absorb the trigger currents of trouble shooting circuits other than the first trouble shooting circuit by energizing silicon contorlled rectifier in the first failure localization trouble shooting circuit, it can exactly identify the first failure or trouble in time therein merely connecting one wire or line to the trouble shooting circuit and store the signal of the first failure even after the fault contact is recovered upon repair of the trouble because the electric current flows from the lock signal terminal of the trouble shooting circuit for identifying the trouble except the trouble shooting circuit identifying the first failure which flows through the silicon controlled rectifier in the first failure trouble shooting circuit. It is also understood that since the trouble localization signals of the first failure and later failures can be applied to the alarm circuit AR connected to the first failure localization trouble shooting circuit device of this invention and the output signals of the trouble contacts $\mathbf{9}_1$, $\mathbf{9}_2$, $\mathbf{9}_3$, . . . are applied to the first output terminal in this invention, it can identify the state of the alarm circuit AR irrespective of the operation of the identifying circuit and accordingly does not adversely affect the operation of the stoppage of the alarm circuit and the blinking of the fault identifying operation thereof.

What is claimed is:

1. A trouble detecting and localization circuit apparatus for identifying a first failure or trouble in time in a sequence of failures or troubles, comprising a plurality of monitor circuit means ($\mathbf{4}_1$, $\mathbf{4}_2$) having trouble detector means ($\mathbf{2}_1$, $\mathbf{2}_2$), with contacts ($\mathbf{9}_1$, $\mathbf{9}_2$) for producing direct current outputs in response to the occurence of trouble at said contacts ($\mathbf{9}_1$, $\mathbf{9}_2$), and trouble localization circuit means ($\mathbf{3}_1$, $\mathbf{3}_2$), and a connecting line operatively coupling said trouble detector means to said trouble localization circuit means, each of said monitor circuit means consisting of:

(a) first and second output terminals ($\mathbf{5}_1$, $\mathbf{5}_1'$; $\mathbf{5}_2$, $\mathbf{5}_2'$) with a first resistor ($\mathbf{10}_1$, $\mathbf{10}_2$), a first diode ($\mathbf{11}_1$, $\mathbf{11}_2$) and a silicon controlled rectifier with a gate, anode and cathode, said first resistor, said first diode and said anode and cathode of said silicon controlled rectifier being connected in series with each other between said first output terminal and ground;

(b) a second resistor having one end connected to the first output terminal; a constant voltage diode having its cathode connected to the other end of the second resistor and its anode connected to the gate of said silicon controlled rectifier;

(c) delay circuit means ($\mathbf{15}_1$, $\mathbf{15}_2$) connected between said gate and ground;

(d) a lock signal terminal ($\mathbf{6}_1$, $\mathbf{6}_2$) and a second diode ($\mathbf{16}_1$, $\mathbf{16}_2$), said lock signal terminal being connected through said second diode to a point between said first diode and the anode of said controlled rectifier;

(e) a third diode ($\mathbf{17}_1$, $\mathbf{17}_2$) connected between the second resistor ($\mathbf{12}_1$, $\mathbf{12}_2$) and the cathode of said constant voltage diode to the lock signal terminals, and said lock signal terminals ($\mathbf{6}_1$, $\mathbf{6}_2$) being interconnected each to the other; and, (f) an alarm circuit means connected between the first and second output terminals of each of said monitor circuit means.

2. An apparatus according to claim 1, wherein an electronic switch, free of mechanical contact, is employed for each of said contacts, and a memory circuit means is connected between the first resistor and said contact.

3. An apparatus according to claim 2, wherein a diode is inserted between the trouble detector means and the trouble localization circuit means, said diode having a positive side, and, a smoothing capacitor is connected between said positive side and the ground so as to smooth out any ripple in the signal produced.

4. An apparatus according to claim 1 wherein said trouble detector means includes a power line and said contact is normally opened and closed upon occurrence of a failure or trouble at said contact and said first resistor is connected in series between said power line and the trouble localization circuit means.

* * * * *